US009570807B2

(12) United States Patent
Inamura et al.

(10) Patent No.: US 9,570,807 B2
(45) Date of Patent: Feb. 14, 2017

(54) ANTENNA MODULE AND TERMINAL APPARATUS

(71) Applicant: FUJITSU LIMITED, Kawasaki-shi, Kanagawa (JP)

(72) Inventors: Ryosaku Inamura, Hadano (JP); Koichi Kasai, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 207 days.

(21) Appl. No.: 14/282,102

(22) Filed: May 20, 2014

(65) Prior Publication Data

US 2014/0368389 A1 Dec. 18, 2014

(30) Foreign Application Priority Data

Jun. 14, 2013 (JP) ..... 2013-126110

(51) Int. Cl.

| | |
|---|---|
| ***H01Q 1/24*** | (2006.01) |
| ***H01Q 7/06*** | (2006.01) |
| ***H01F 27/36*** | (2006.01) |
| ***H01F 38/14*** | (2006.01) |
| ***H01Q 1/52*** | (2006.01) |
| *H01Q 7/00* | (2006.01) |

(52) U.S. Cl.

CPC ..... *H01Q 7/06* (2013.01); *H01F 27/365* (2013.01); *H01F 38/14* (2013.01); *H01Q 1/243* (2013.01); *H01Q 1/526* (2013.01); *H01Q 7/00* (2013.01)

(58) Field of Classification Search

CPC ..... H01Q 1/243; H01Q 1/38; H01Q 9/0421
USPC ..... 343/702, 872, 878
See application file for complete search history.

(56) References Cited

U.S. PATENT DOCUMENTS

| | | | | |
|---|---|---|---|---|
| 2005/0088342 | A1* | 4/2005 | Parsche | H01Q 1/38 343/700 MS |
| 2005/0162331 | A1 | 7/2005 | Endo et al. | |
| 2006/0267854 | A1* | 11/2006 | Naito | H01Q 1/22 343/788 |
| 2008/0191028 | A1* | 8/2008 | Kagaya | G06K 19/07749 235/492 |
| 2009/0167498 | A1 | 7/2009 | Fukuda et al. | |
| 2009/0315553 | A1 | 12/2009 | Arimura | |
| 2010/0052859 | A1* | 3/2010 | Lossau | G06K 19/07749 340/10.1 |

(Continued)

FOREIGN PATENT DOCUMENTS

| | | | |
|---|---|---|---|
| EP | 0782214 | A1 | 7/1997 |
| JP | 200438552 | A | 2/2004 |

(Continued)

OTHER PUBLICATIONS

Extended European Search Report dated Nov. 24, 2014, issued in corresponding European Patent Application No. 14169076.8 (6 pages).

*Primary Examiner* — Dameon E Levi
*Assistant Examiner* — Collin Dawkins
(74) *Attorney, Agent, or Firm* — Westerman, Hattori, Daniels & Adrian, LLP

(57) ABSTRACT

An antenna module includes an antenna line disposed annularly, a magnetic body formed annularly along the antenna line, having a bottom part and a pair of side parts to accommodate the antenna line, and provided with end faces of the pair of side parts disposed in a same direction, and an insulator disposed between the magnetic body and the antenna line.

16 Claims, 8 Drawing Sheets

(56) References Cited

U.S. PATENT DOCUMENTS

| | | | | |
|---|---|---|---|---|
| 2013/0222198 | A1* | 8/2013 | Kojima ..... | H01Q 7/06<br>343/788 |
| 2013/0249312 | A1 | 9/2013 | Uchida et al. | |

FOREIGN PATENT DOCUMENTS

| | | | |
|---|---|---|---|
| JP | 2006-295981 | A | 10/2006 |
| WO | 2007/043626 | A1 | 4/2007 |
| WO | 2012/073305 | A1 | 6/2012 |

* cited by examiner

ANTENNA MODULE AND TERMINAL APPARATUS

CROSS-REFERENCE TO RELATED APPLICATION

This application is based upon and claims the benefit of priority of the prior Japanese Patent Application No. 2013-126110, filed on Jun. 14, 2013, the entire contents of which are incorporated herein by reference.

FIELD

The embodiment discussed herein is related to an antenna module including a magnetic body for generating magnetic flux, and a terminal apparatus including the antenna module.

BACKGROUND

Some of terminal apparatuses have a near field communication function, such as electronic money, and the like, and a loop antenna is used as an antenna for performing near field communication. When a housing of a terminal apparatus is formed by resin, even if an antenna is accommodated in the housing, a high-frequency magnetic field caused by electromagnetic induction reaches outside through the housing, and thus it is possible to perform information transmission with a predetermined resonance frequency.

In recent years, for a housing of a terminal apparatus, a high rigidity material have been used in order to provide a nice outer view, a pleasant feel, and so on, with smooth touch and excellent design. For example, a metal, a carbon, or the like has come to be used. Such a high rigidity material is mostly made of conductive material, and thus if an antenna is disposed inside the housing that is made of conductive material, it is not possible to generate a high-frequency magnetic field outside the terminal.

To date, as a technique for disposing an antenna on a housing made of such a conductive material, a technique having a structure, in which coil is wound around a magnetic core member, and an end part of the antenna is opposed to an end part of a magnetic core member of the opposite side communication apparatus in order to allow communication, has been disclosed. Also, by disposing a magnetic body in the vicinity of an antenna disposed in a case made of a conductive material, techniques have been disclosed with a structure that offsets a decrease in inductance by the case against an increase in inductance by the magnetic body. For example, related-art techniques have been disclosed in International Publication Pamphlet No. 2007/043626, and Japanese Laid-open Patent Publication No. 2004-038552.

SUMMARY

According to an aspect of the invention, an antenna module includes an antenna line disposed annularly, a magnetic body formed annularly along the antenna line, having a bottom part and a pair of side parts to accommodate the antenna line, and provided with end faces of the pair of side parts disposed in a same direction, and an insulator disposed between the magnetic body and the antenna line.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENT

As described above, in order to obtain a function of near field communication using a housing made of a highly rigid conductive material, it is desired that an antenna be disposed outside the housing. In this case, if the antenna is simply disposed on the surface of the housing, an antenna portion protrudes from the housing in a convex state. Also, in order to protect the antenna portion, it is desired that an antenna cover made of resin or the like be further provided. Further, the amount of protrusion becomes large so that in the case of a mobile terminal apparatus, the mobile terminal apparatus gives unpleasant feel, such as unpleasant touch, and so on. Also, the protruding antenna portion becomes susceptible to damage. And the protruding antenna deteriorates an outer view, such as spoiling the beauty of a terminal apparatus, and so on.

Also, in the case of disposing a magnetic body around the antenna portion, the housing is covered with a magnetic body, and thus the housing is unable to be seen. Accordingly, the meaning and the function are spoiled of using a high-rigidity conductive material for the housing for the sake of a pleasant feel, smooth touch, a sense of beauty, and so on.

Structure of Antenna Module

Figure 1:
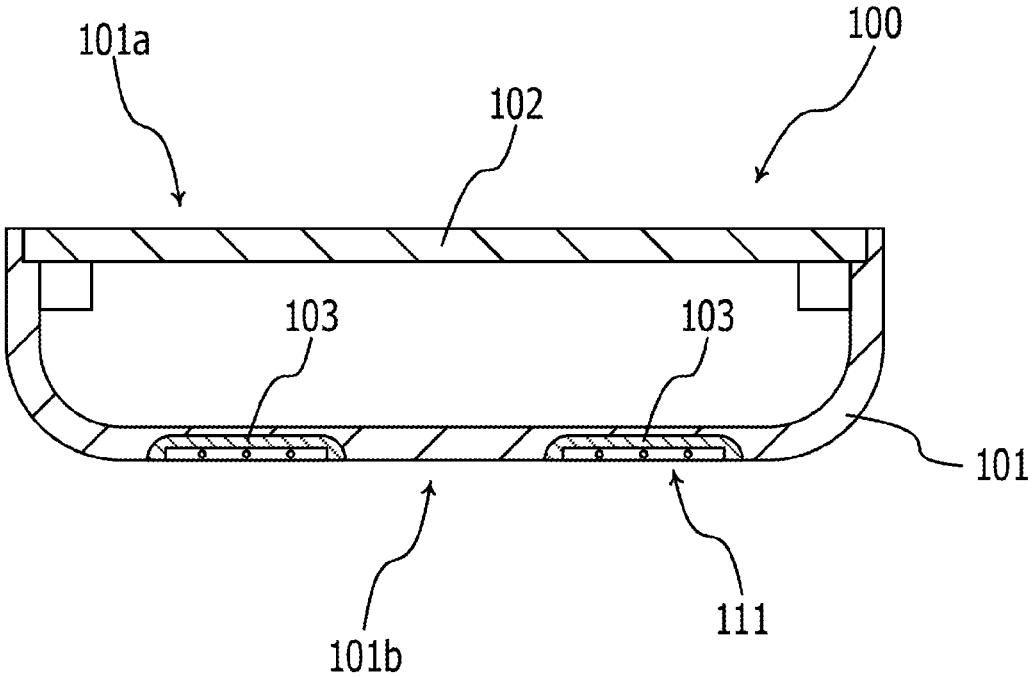
FIG. 1 is a sectional view illustrating a terminal apparatus including an antenna module according to an embodiment.

In the following, a detailed description will be given of a preferable embodiment of the disclosed technique with reference to the accompanying drawings. FIG. 1 is a sectional view illustrating an terminal apparatus including an antenna module according to the embodiment.

The terminal apparatus 100 is, for example, a mobile terminal apparatus, specifically, a mobile phone, a tablet terminal, a PDA, and the like, and includes a data processing function unit, such as a CPU, a memory, and the like inside a housing 101. A display 102 is disposed on a surface 101*a* of the housing 101, and displays data, and so on processed by the data processing function unit.

The housing 101 is formed by a high rigidity material. For the high rigidity material, it is possible to use a metal, for example, stainless steel (SUS), Al, Ti, Al alloy, Ti alloy, and so on, and carbon, carbon reinforced resin, and so on.

A concave portion 103 is formed on a back face 101*b* of the housing 101, and an antenna module 111 is accommodated in the concave portion 103. It is possible to form the concave portion 103 by subjecting the housing 101 to cutting, press molding, a combination of cutting and press molding, and so on. The antenna module 111 transmits and receives a radio wave for near field communication with an opposed communication device, which is not illustrated in the figure, such as a reader, for example.

A wireless communication function unit is disposed inside the housing 101, and the wireless communication function unit transmits and receives data with the opposed communication device through the antenna module 111 via a radio wave. The transmitted and received data are output from and input to the data processing function unit, respectively.

Figure 2:
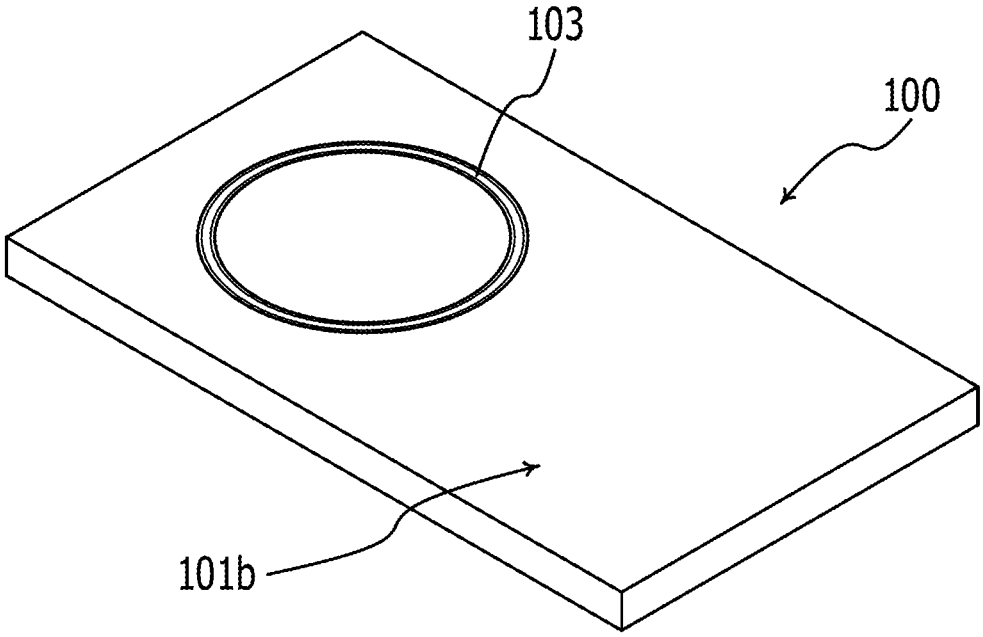
FIG. 2 is a perspective view of the terminal apparatus.

FIG. 2 is a perspective view of the terminal apparatus. FIG. 2 is the view taken from the back face 101*b* of the terminal apparatus 100. As illustrated in FIG. 2, the concave portion 103 accommodates the loop-shaped (annular) antenna module 111. In the example in FIG. 2, as a loop-shaped (annular) example, the antenna is formed in a circle as a plan view. However, the present disclosure is not limited to this. It is possible to form the antenna in various shapes, such as a quadrilateral, a polygon, and in a shape having a step partly, or the like.

Figure 3:
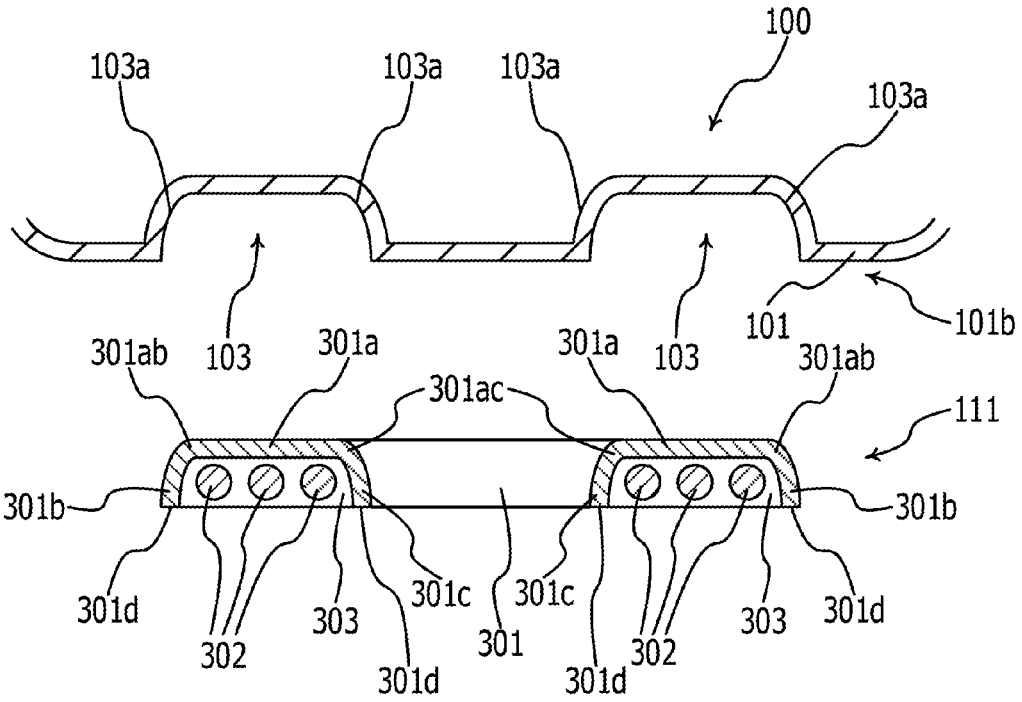
FIG. 3 is a sectional view of the antenna module.

FIG. 3 is a sectional view of the antenna module. The concave portion 103 of the housing 101 that accommodates the antenna module 111 is also illustrated. The antenna module 111 includes a magnetic body 301, antenna lines 302, and an insulator 303.

The magnetic body 301 is formed by a ferritic material or a ferrite sintered body. For a ferritic material, it is possible to use a material formed by kneading fine particles of FeAlSi (sendust), Fe—Cr based alloy, Fe—Ni based alloy, and so on into a non-conductive (non-magnetic body) binder.

The magnetic body 301 is disposed continuously on all the parts that contact the concave portion 103 when accommodated in the concave portion 103 of the housing 101. The magnetic body 301 includes a bottom part 301*a*, and an outer circumferential part 301*b* and an inner circumferential part 301*c* as a pair of side parts. The magnetic body 301 is formed in a loop (annular) shape as a plan view, and is formed in substantially a U-shape as a sectional view as illustrated in FIG. 3. Both of U-shaped end parts (end faces) 301*d* are disposed in the same direction (a direction toward the outside of the housing 101 in the example in FIG. 3).

And a joint part 301*ab* between the bottom part 301*a* and the outer circumferential part 301*b*, and a joint part 301*ac* between the bottom part 301*a* and the inner circumferential part 301*c* are formed in a shape having an angle changing continuously without having an angular part individually, for example, formed in a circular-arc shape. As illustrated in FIG. 3, it is possible for the circular arcs of the joint parts 301*ab* and 301*ac* to have a varied curvature in addition to have a fixed curvature.

In an annular space formed by the bottom part 301*a* of the magnetic body 301, the outer circumferential part 301*b*, and the inner circumferential part 301*c*, a plurality of antenna lines 302 are accommodated, and the antenna lines 302 are held in the space of the magnetic body 301 by the insulator 303. The antenna lines 302 are disposed in a loop-shaped (annular) state in the space of the magnetic body 301.

The concave portion 103 of the housing 101 is formed in accordance with an outer shape of the magnetic body 301. And the parts of the concave portion 103 that contact the joint parts 301*ab* and 301*ac* of the magnetic body 301 include an arc part 103*a* having a curvature corresponding to the curvature of the joint parts 301*ab* and 301*ac*.

Figure 4:
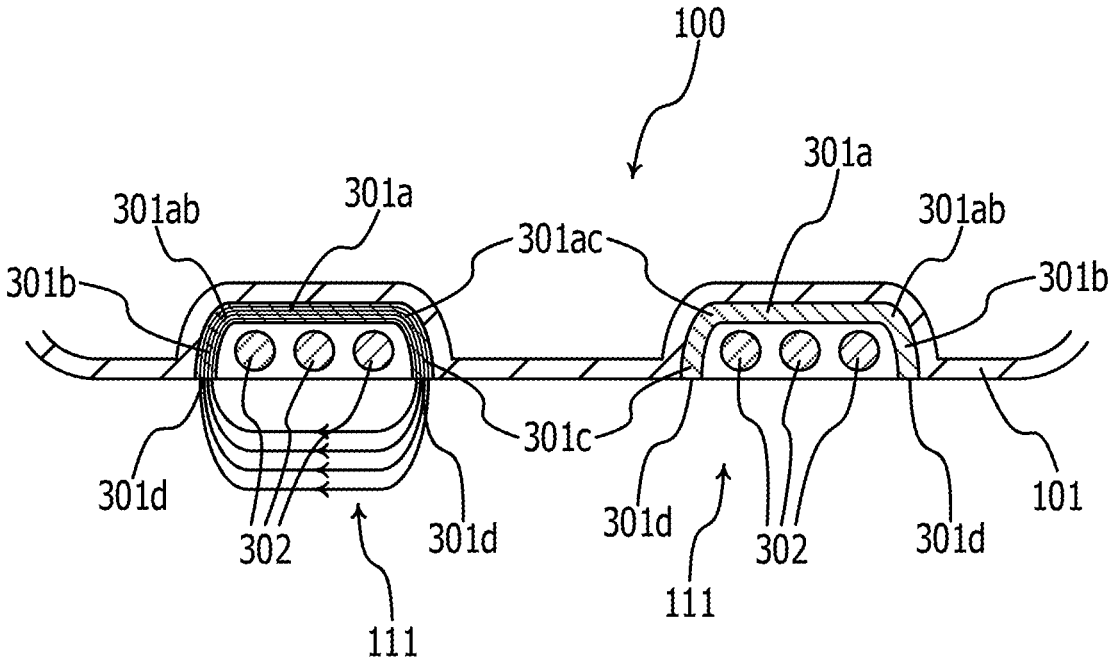
FIG. 4 is a sectional view illustrates a state of accommodating the antenna module in a housing.

FIG. 4 is a sectional view illustrating a state of accommodating the antenna module in the housing. By accommodating the antenna module 111 in the concave portion 103 of the housing 101, the concave portion 103 contacts the magnetic body 301 of the antenna module 111. It is possible for the magnetic body 301 of the antenna module 111 to fixedly hold an accommodated state in the concave portion 103 using adhesive agent, double-coated adhesive tape, and so on. And only the magnetic body 301 of the antenna module 111 continuously contacts the high rigidity material, for example, the housing 101 made of the conductive material with a predetermined distance from the concave portion 103.

Thereby, as illustrated in FIG. 4, it is possible for the magnetic flux generated from the antenna module 111 to go out toward the outside of the housing 101 from the end face 301*d* of the magnetic body 301 that is exposed on the back face 101*b* of the housing 101. It is possible to generate an intensive alternating current (AC) magnetic field caused by a large number of lines of magnetic flux passing through the magnetic body 301 from the end face 301*d*. At this time, it is possible to avoid a decrease of the magnetic flux by the conductive material housing 101, and to generate a high-frequency magnetic field efficiently.

Here, out of the magnetic body 301, the joint parts 301*ab* and 301*ac* are formed in a circular arc so as to decrease leakage of the magnetic flux from the magnetic body 301. That is to say, if the joint parts 301*ab* and 301*ac* are formed to bend abruptly at a right angle, the magnetic flux is liable to leak from these parts. By forming the joint parts 301*ab* and 301*ac* in a circular arc, leakage of the magnetic flux is reduced.

And the depth of the concave portion 103 of the housing 101 is made to match the height oft the magnetic body 301 of the antenna module 111. Thereby, the antenna module 111 does not generate a step (a protrusion or a concavity) with respect to the back face 101*b* position of the housing 101, and thus it is possible to keep the back face 101*b* flat. Also, it is possible to provide the back face 101*b* with the antenna module 111 without spoiling an outer view of the back face 101*b* of the housing 101. And the antenna module 111 does not protrude from the back face 101*b*, and thus it is possible to avoid damage.

In this manner, the antenna module 111 according to the embodiment has a structure in which the magnetic body 301 forms a U-shaped space, and accommodates the antenna lines 302 in the space unlike a structure in which the antenna lines 302 are wound around the magnetic body 301 in a coil state. And the end face 301*d* of the magnetic body 301 located at the inner circumferential portion and the outer circumferential portion of the loop-shaped antenna lines 302 generates magnetic flux toward the outside of the housing 101 (the back face 101*b*).

Thereby, by embedding the antenna module 111 in the surface (the back face 101*b*) of the conductive material housing 101, it is possible to efficiently generate magnetic flux toward the outside, and thus it becomes possible to perform favorable communication.

Also, since the antenna line is not wound around the magnetic body, it is possible to make the height of the antenna module 111 (the thickness from the bottom part 301*a* of the magnetic body 301 to the end face 301*d*) short. Also, it is possible not to generate a step that occurs in the case of winding the antenna line, and thus it is possible to keep the height (thickness) even. Further, the antenna line 302 does not appear outside, and is accommodated inside the magnetic body 301. Accordingly, it is possible to avoid the antenna lines 302 being damaged, such as being cut, and so on. Also, a large portion of the antenna module 111 is covered by the magnetic body 301 having rigidity, and thus it becomes easy to handle the antenna module 111.

Figure 5:
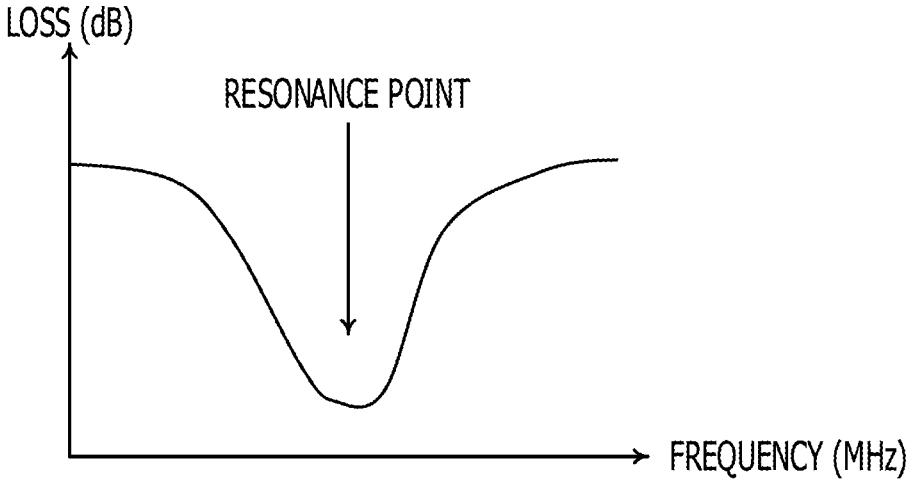
FIG. 5 is a diagram illustrating an example of a resonance frequency characteristic of the antenna module according to the embodiment.

FIG. 5 is a diagram illustrating an example of a resonance frequency characteristic of the antenna module according to the embodiment. The horizontal axis in FIG. 5 represents frequency (MHz), and the vertical axis represents loss (dB). As illustrated in FIG. 5, even if the housing 101 is formed by a conductive material, it is possible to obtain a predetermined resonance point (for example, 13.4 MHz), and to perform communication by the magnetic field generated by the antenna module 111. Thereby, it is possible for the terminal apparatus 100 including the antenna module 111 to generate an alternating current magnetic field that reaches the opposed communication device (for example, reader). Accordingly, it is possible to perform stable communication with the opposed communication device.

Figure 6A:
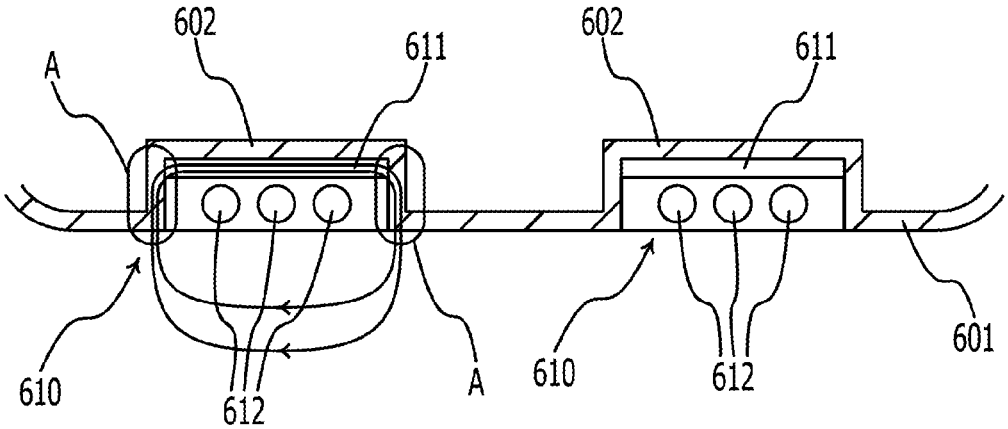
FIGS. 6A and 6B are explanatory diagrams when another antenna configuration is used as a reference.
Figure 6B:
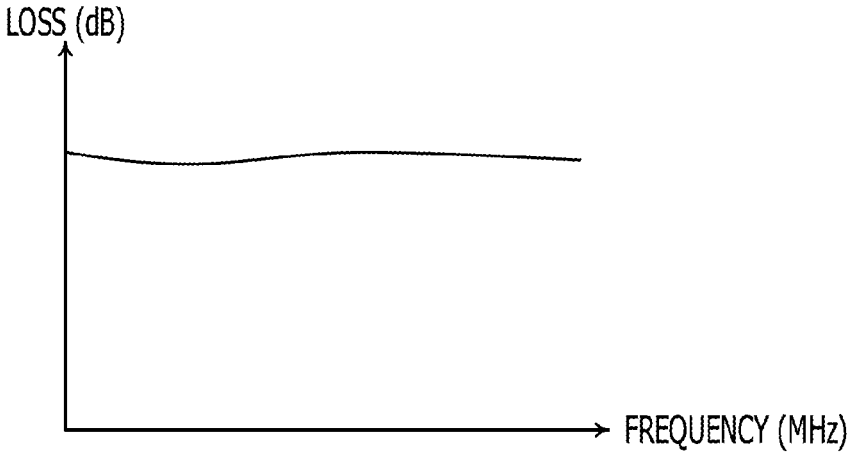

FIGS. 6A and 6B are explanatory diagrams when another antenna configuration is used as a reference. As illustrated in a sectional view in FIG. 6A, a concave portion 602 is formed on the housing 601, and a planar magnetic body 611 and antenna lines 612 (and an insulator) are accommodated as an antenna module 610. As illustrated in this configuration, in a configuration in which a concave portion 602 is simply formed in the housing 601, and only the antenna module 610 is simply accommodated in the concave portion 602, the number of lines of the generated magnetic flux decreases, and it is not possible to ensure communication performance.

This is because the magnetic flux passing the magnetic body 611 passes the conductive material housing 601 at an A portion in FIG. 6A. In this configuration, a counter electromotive force is generated at the A portion, and thus the number of lines of magnetic flux decreases to reduce the alternating current (AC) magnetic field. And, as illustrated in FIG. 6B, such an antenna module 610 does not generate a resonance point, and thus an alternating current magnetic field does not reach the opposed communication device, thereby making it not possible to perform communication with the opposed communication device.

Implementation of Antenna Module in Housing

Figure 7:
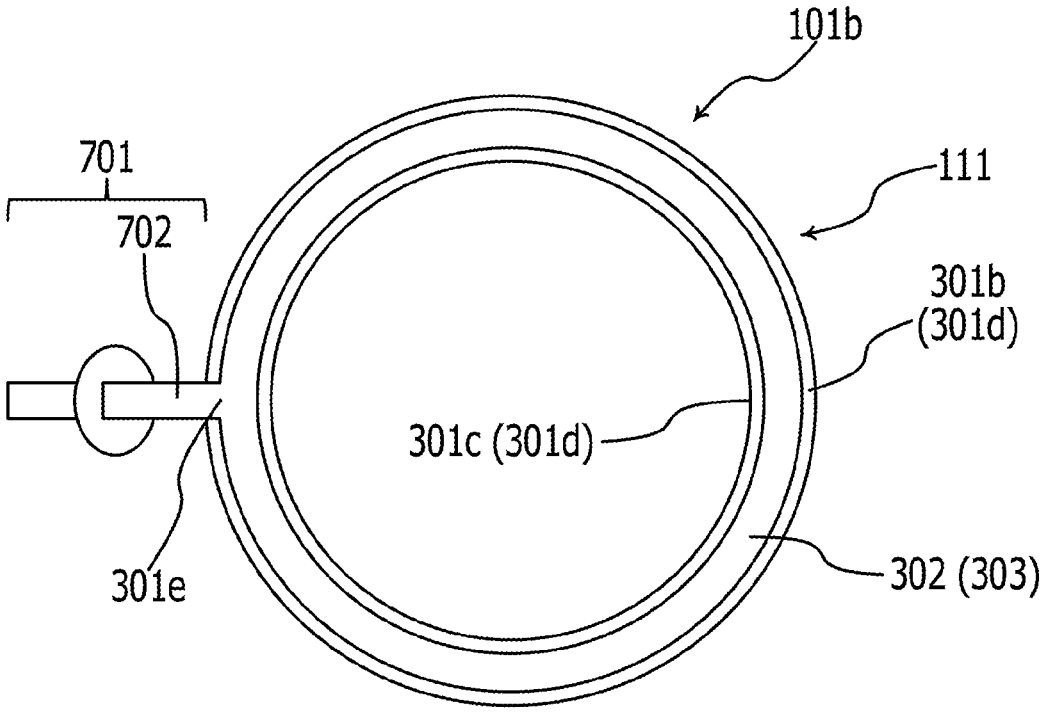
FIG. 7 is a plan view illustrating an implementation state of the antenna module according to the embodiment.

FIG. 7 is a plan view illustrating an implementation state of the antenna module according to the embodiment. FIG. 7 illustrates a view of the antenna module 111 taken from the back face 101*b* of the housing 101. As illustrated in FIG. 7, in the magnetic body 301 of the loop-shaped antenna module 111, one place of the outer circumferential part 301*b* or the inner circumferential part 301*c* is provided with an open part 301*e*. And a connection wire 702 is conductively connected to the antenna line 302 through the open part 301*e*. The connection wire 702 leads the antenna module 111 to the outside through the connection part 701 including the connection wire 702, and connects to the wireless communication function unit described above.

Figure 8:
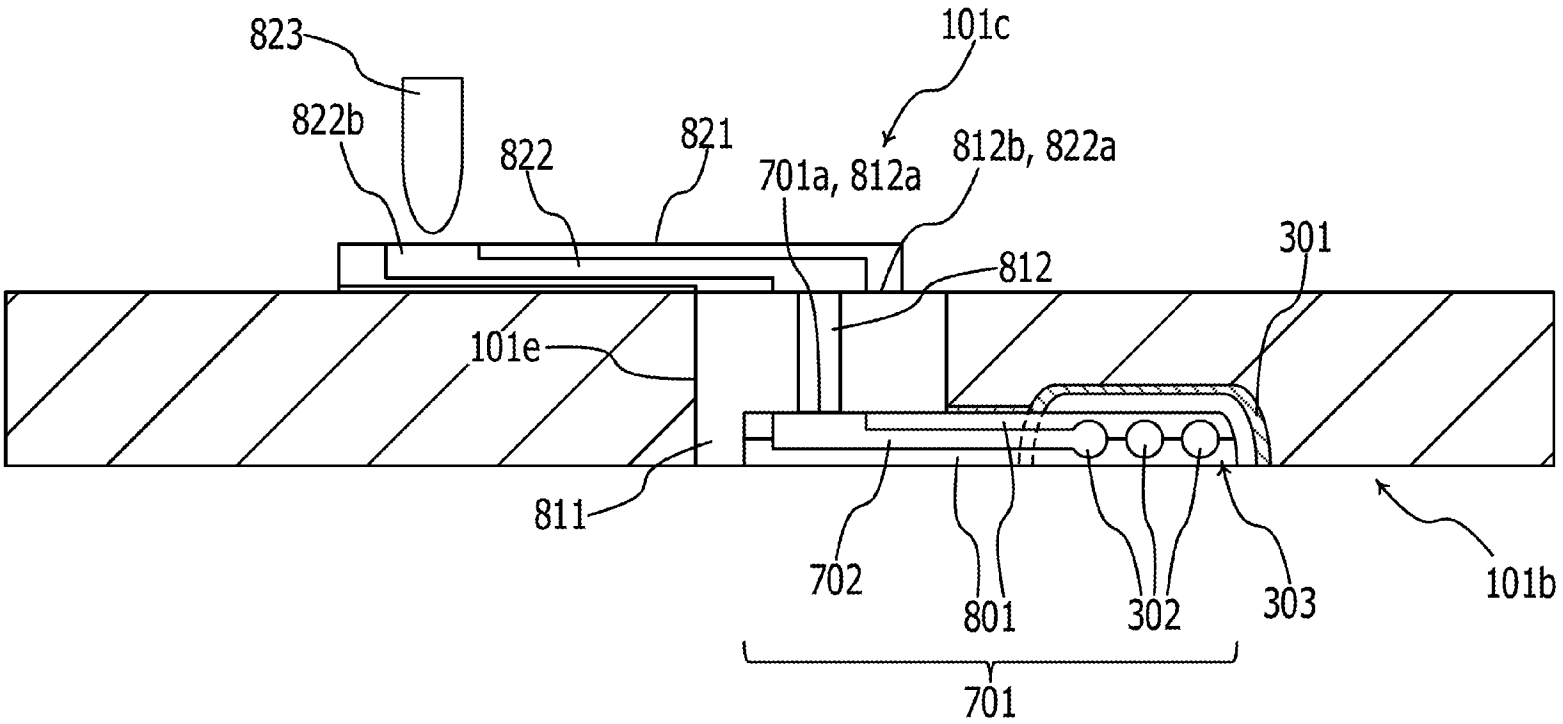
FIG. 8 is a sectional side view illustrating an implementation state of the antenna module according to the embodiment.

FIG. 8 is a sectional side view illustrating an implementation state of the antenna module according to the embodiment. FIG. 8 mainly illustrates an external leading-out state of the antenna line 302 of the antenna module 111. As illustrated in FIG. 8, the connection part 701 uses two sheets of insulating resin films 801 made of epoxy resin, and so on that are laminated (glued together) and provided with the antenna line 302 and the connection wire 702 therebetween. The connection wire 702 may be formed on one of the resin films 801 by printed wiring. Thereby, it becomes easy to accommodate the antenna line 302 in the magnetic body 301.

At the position of the end part 701*a* of the connection part 701 (connection wire 702), the housing 101 is provided with a connecting member 811 that leads the connection wire 702 to an inside 101*c* of the terminal apparatus 100 (housing 101). The connecting member 811 is formed by a resin member, and is insulated from the housing 101 formed by a conductive material. An inner part of the connecting member 811 is provided with a conductive metal member 812 from the back face 101*b* of the housing 101 toward the inside 101*c* by insertion, or the like.

One end 812*a* of the metal member 812 is conductively connected to the end part 701*a* of the connection part 701 by soldering, or the like, and the other end 812*b* is connected to a connection wire 822 disposed on the inside 101*c*. The connecting member 811 is disposed by pressing, or the like into an open part 101*e* of the housing 101.

The connection wire 822 disposed in the inside 101*c* of the terminal apparatus 100 (housing 101) includes, for example, a laminated body of the resin films 821 and the connection wire 822 inside in the same manner as the connection part 701. In addition, a substrate on which a connection wire 822 is formed may be used. One end 822*a* of the connection wire 822 is conductively connected to the other end 812*b* of metal member 812 by soldering, or the like. The other end 822*b* is conductively connected to a substrate contact point 823, such as a pogo pin, or the like. Thereby, it is possible to lead the antenna line 302 of the antenna module 111 to the above-described wireless communication function unit through the substrate contact point 823.

By the above-described embodiment, it becomes possible to favorably perform communication using the antenna module with the use of high-rigidity conductive material for the housing in order to obtain a pleasant feel, smooth touch, a sense of beauty, and so on while making the housing to be seen. The antenna module is disposed in the concave portion of the housing, but the magnetic body is disposed at a portion contacting the concave portion. Thus, the antenna line is accommodated in the inside of the magnetic body, and magnetic flux is generated outward from both of the end faces. Thereby, even if a conductive material is used for the housing, it is possible to avoid a decrease in the number of lines of the magnetic flux caused by the housing. Accordingly, it becomes possible to efficiently generate a large number of lines of the magnetic flux, and to perform favorable near field communication.

Also, the antenna module is accommodated in the concave portion of the housing, and thus a needless protrusion does not arise on the surface of the housing. Accordingly, it is possible to keep the housing surface even, and to avoid damage of the antenna without spoiling a pleasant feel.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. An antenna module comprising:

an antenna line disposed annularly;

a magnetic body formed annularly along the antenna line, having a bottom part, a pair of side parts continuously formed from respective sides of the bottom part and an opening between end faces of the pair of side parts and configured to accommodate the antenna line in the opening; and an insulator disposed in the opening so as to surround a whole of an outer surface of the antenna line.

2. The antenna module according to claim 1, wherein the magnetic body is shaped to have a connection part between the bottom part and the pair of side parts with a continuously changing angle.

3. The antenna module according to claim 1, wherein the bottom part is fixedly connected to a housing formed by a conductive material, and the end faces are disposed facing in an outer direction of the housing.

4. The antenna module according to claim 1, wherein an open part is formed at a portion of the annular side parts of the magnetic body, and the antenna line is externally lead out in an insulating state through the open part.

5. The antenna module according to claim 1, wherein the insulator is formed by a resin film divided into two with the antenna line as center, and the insulator is sandwiched by laminating the resin films.

6. A terminal apparatus comprising:

an antenna module including an antenna line disposed annularly, a magnetic body formed annularly along the antenna line, having a bottom part and a pair of side parts to accommodate the antenna line, and provided with end faces of the pair of side parts disposed in a same direction, and an insulator disposed between the magnetic body and the antenna line; and a housing formed by a conductive material, and including, on an outer surface, a concave portion formed in accordance with the antenna module in shape and to be fixedly connected to the bottom part of magnetic body, wherein the end faces of the pair of side parts of the magnetic body are disposed in an outer direction of the housing.

7. The terminal apparatus according to claim 6, wherein the magnetic body is shaped to include a connection part between the bottom part and the pair of side parts with a continuously changing angle.

8. The terminal apparatus according to claim 6, wherein a depth of the concave portion of the housing is identical to a height of the magnetic body of the antenna module.

9. The terminal apparatus according to claim 6, wherein an open part is formed at a portion of the annular side parts of the magnetic body, and the antenna line is internally led to the housing in an insulating state through the open part.

10. The terminal apparatus according to claim 9, wherein a connection wire conductive to the antenna line is led to an inside of the housing through the open part passing through from a front side of the housing to the inside of the housing.

11. An antenna module comprising:

an antenna line disposed annularly;

a magnetic body formed annularly along the antenna line, having a bottom part and a pair of side parts to accommodate the antenna line, and provided with end faces of the pair of side parts disposed in a same direction; and an insulator disposed between the magnetic body and the antenna line wherein the bottom part is fixedly connected to a housing formed by a conductive material, and the end faces are disposed facing in an outer direction of the housing.

12. The antenna module according to claim 11, wherein the magnetic body is shaped to have a connection part between the bottom part and the pair of side parts with a continuously changing angle.

13. The antenna module according to claim 11, wherein an open part is formed at a portion of the annular side parts of the magnetic body, and the antenna line is externally lead out in an insulating state through the open part.

14. The antenna module according to claim 11, wherein the insulator is formed by a resin film divided into two with the antenna line as center, and the insulator is sandwiched by laminating the resin films.

15. The antenna module according to claim 1, wherein the insulator is directly in contact with the outer surface of the antenna line.

16. An antenna module comprising:

an antenna line disposed annularly;

a magnetic body formed annularly along the antenna line, having a bottom part and a pair of side parts to accommodate the antenna line, and provided with end faces of the pair of side parts disposed in a same direction; and an insulator disposed between the magnetic body and the antenna line, wherein an open part is formed at a portion of the annular side parts of the magnetic body, and the antenna line is externally lead out in an insulating state through the open part.

* * * * *